United States Patent [19]

Sturm

[11] 3,946,872

[45] Mar. 30, 1976

[54] SEALABLE AND STERILIZABLE PACKAGE

[75] Inventor: Winfried Gerhard Sturm, Goldach, Switzerland

[73] Assignee: Alcan Aluminum Corporation, Cleveland, Ohio

[22] Filed: Sept. 27, 1974

[21] Appl. No.: 509,747

[52] U.S. Cl. ..... 206/498; 220/64; 229/3.5 MF; 229/43

[51] Int. Cl.[2] ..... B65D 51/20; B65D 85/72

[58] Field of Search ..... 206/525, 498, 363, 364, 206/438, 63.3; 229/48 T, 3.5 MF, 43, 66; 220/70, 74, 64

[56] References Cited

UNITED STATES PATENTS

| | | | |
|---|---|---|---|
| 3,256,981 | 6/1966 | Kurtz | 229/48 T |
| 3,454,210 | 7/1969 | Spiegel et al. | 229/43 |
| 3,655,503 | 4/1972 | Stanley et al. | 229/48 T |
| 3,750,827 | 8/1973 | Wick | 229/3.5 MF |

*Primary Examiner*—William T. Dixson, Jr.
*Attorney, Agent, or Firm*—Cooper, Dunham, Clark, Griffin & Moran

[57] ABSTRACT

A package made of metal foil or light-gauge sheet, having a bottom and lid each lined internally with a lacquer and heat-sealed together by means of the lacquer to provide a sealed, sterilizable, shelf-stable container for food or the like, which does not require refrigeration for storage. The lid is manually peelable from the bottom, with defoliation of the lid lining along the locality of the seal, providing a neat and attractive appearance for the opened container. Specifically different vinyl resin based lacquer systems may be employed for the bottom and lid linings.

17 Claims, 4 Drawing Figures

Fig. 1.
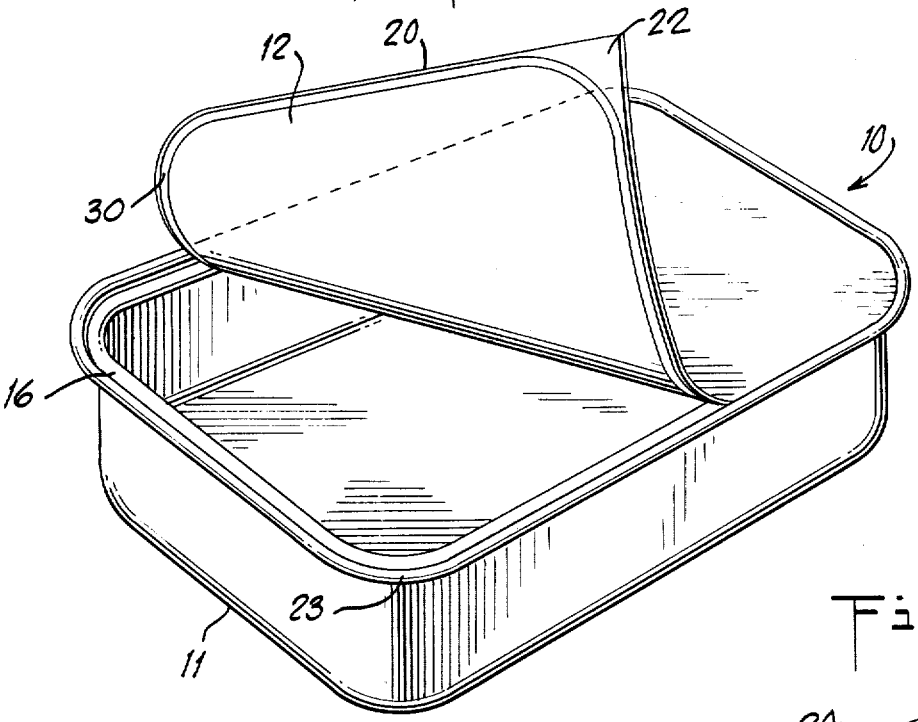
Fig. 4.
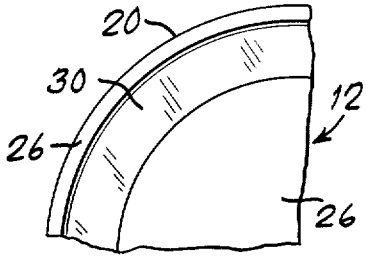
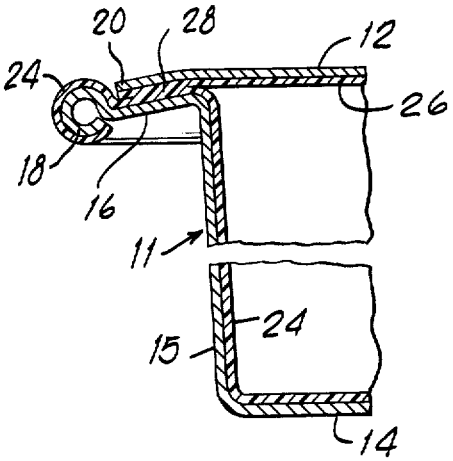
Fig. 2.
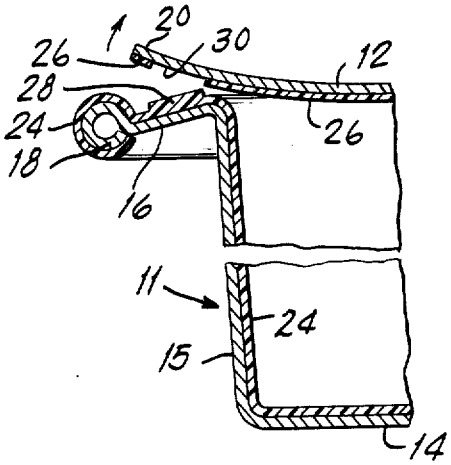
Fig. 3.

SEALABLE AND STERILIZABLE PACKAGE

BACKGROUND OF THE INVENTION

This invention relates to sealable and sterilizable packages made of metal foil or light-gauge sheet suitable for containing products such as foodstuffs and the like. More particularly, it relates to packages of the type described including a bottom and a lid readily separable by manual peeling of the lid for access to the contents. In an important specific sense, the invention is directed to aluminum foil and/or light gauge sheet packages having a bottom member and lid member each internally lined with a coating of thermoplastic material. The term "aluminum," as herein used, embraces aluminum metal and alloys thereof.

For simplicity of discussion, detailed reference will be made herein to aluminum foil containers as an illustrative and indeed especially advantageous example of the types of containers with which the present invention is concerned; but it is to be understood that in a broad sense the invention generally embraces containers made of metal foil and/or light-gauge metal sheet.

Aluminum foil and light-gauge sheet are widely employed in the packaging of foodstuffs, e.g. in containers for retail sale. By way of example, an aluminum foil package for such purposes may comprise a relatively stiff, shaped foil bottom and a lid of foil lighter in gauge than the bottom, with an internal thermoplastic lining or coating on both the lid and the bottom to separate the contained food from the metal of the foil. These linings must be inert with respect to the foodstuff; i.e. they must not exhibit water staining or blushing or affect the taste of the food.

Aluminum foil containers and the like have heretofore commonly been used for packaging frozen foods. There are various disadvantages associated with frozen foods, however, including the necessity of providing refrigerated storage as well as the energy consumption and sometimes inconvenient delays involved in heating the food from frozen condition before or during cooking. It has, of course, long been known to package foods for preservation at room temperature under sterile conditions by canning, but metal containers for that purpose have conventionally been relatively heavy cans adapted to be opened only by means of a tool.

The provision of a manually openable aluminum foil or like container, which can be sealed and sterilized to provide shelf-stable packaging of foods at room temperature (i.e. packaging that preserves the contained food in unimpaired and safely usable condition for extended periods of room-temperature shelf storage) constitutes a particularly important aspect of the present invention. Such packaging is desirable as obviating both the disadvantages of frozen foods and the inconvenience and other drawbacks of conventional cans. In this aspect, the invention is concerned with provision of a foil or like container that is capable of replacing conventional "tin cans" for shelf-stable room-temperature food storage, as distinguished from frozen food packages, and which provides at the same time the advantages of light-weight and easy manual access to the contents without use of a can opener.

For these and other uses of aluminum foil containers, preservation of the contents in satisfactory condition for safe use requires that the container be sealed and sterilized. It has heretofore been proposed to seal the lid and bottom thermoplastic linings of an aluminum foil package together, utilizing as the lining materials thermoplastic substances which are stable at sterilization temperatures. A typical sterilization temperature for many food products is about 120° C.

At the same time, it is desirable that such a package be readily manually openable for convenience of access to the contents by a consumer. Prior foil packages adapted for sealing and sterilization have been difficult to open, either tearing unevenly when an attempt is made to separate the lid from the bottom, or requiring the use of an implement such as a knife for cutting through the lid and its associated lining. Efforts previously made to achieve a sealable and sterilizable shelf-stable foil package in which the lid and bottom are easily separable by parting of the seal between them, so as to enable manual peeling of the lid from the bottom, have been unsatisfactory owing to failure to achieve a reliably sealed and sterile package. This failure is presently believed attributable to the fact that the lid lining material selected to provide a seal separable by peeling has failed to maintain satisfactory adherence to the foil surface of the lid and/or to the lining material of the bottom with which it is supposed to form a seal.

A further important consideration, in a practical sense, is that opening of the package should not result in visible and unsightly irregularities along the rim of the bottom. Such irregularities are aesthetically undesirable, especially where the bottom may be used as a serving vessel for the contents, and may seriously detract from consumer acceptance of the package.

SUMMARY OF THE INVENTION

An object of the present invention is to provide a new and improved sealed, sterilizable light-gauge metal sheet and/or foil package characterized both by high reliability of the sterile seal and ease and neatness of manual opening of the package. Another object is to provide such a package which is shelf-stable, i.e. capable of preserving contained foodstuffs for extended periods of room-temperature shelf storage. Still another object is to provide such a package wherein the lid separates cleanly from the bottom when manually opened, leaving no unsightly marring or visible irregularity along the rim of the bottom. A further object is to provide a sealed sterilizable aluminum light-gauge sheet and/or foil package which can be opened by peeling of the lid from the bottom.

To these and other ends, the present invention broadly contemplates the provision of a package including a metal foil or light-gauge sheet bottom, a first thermoplastic lining adhering to and covering the inner surface of the bottom, a metal foil or light-gauge sheet lid, and a second lining of thermoplastic material adhering to and covering the inner surface of the lid, the bottom having a lip over which the first lining extends, and the lid having an edge portion overlying the lip with the second and first linings sealed together along the lip. Both thermoplastic linings are formed of material or materials which are inert with respect to the contents of the package (that is, materials which are not attacked by foods or by acids or salt present in or with the contained food) and which are stable at sterilization temperatures of at least about 120° – 125° C. In accordance with the present invention and as a particular feature thereof, the thermoplastic material of the second (i.e. lid) lining is a material which effectively and reliably adheres to the metal surface of the lid and to the first lining material at temperatures up to and including the aforementioned sterilization temperatures and which forms with the first lining material a fully effective sterilizable seal providing a shelf-stable package that opens evenly and neatly when the lid is peeled manually from the bottom without tearing of the lid, unsightly disfigurement of the bottom rim, or separation of the lid lining from the metal of the lid except along the locality of the seal.

More particularly, the lid lining in accordance with the invention is of such character that when the lid is peeled from the bottom of the container, that portion of the lid lining which is bonded to the bottom lining (i.e. along the rim of the bottom) is selectively stripped from the metal surface of the lid. Stated in other words, the seal formed by the mutually bonded portions of the lid and bottom linings parts from the lid metal as the lid is peeled off but remains adherent to the rim of the bottom, and also parts from the remainder of the lid lining, which thus remains adherent to the lid metal. This selective stripping or parting of the seal-forming portion of the lid lining, both from the lid metal and from the remainder of the lid lining, is herein termed defoliation. By virtue of such defoliation, visible marring or disfigurement of the bottom rim is avoided, because the rim remains fully coated with material of the linings (so that no bare metal is exposed at the rim), yet no unsightly loose fragments or tatters of lid lining material project therefrom.

The metal of both the lid and the bottom may be aluminum, e.g. aluminum foil. In such case, the foil of the bottom may for example be of a heavier gauge than the lid foil so as to retain a desired container shape when formed into such shape.

Specifically, the present invention embraces the provision of containers as generally described above having bottom and lid linings constituted of particular types of lacquers which are characterized by resistance to attack by food acids and salt; a melting range above sterilization temperatures; appropriate bonding and sealing properties to provide a sterilizable, shelf-stable package for storage of food in unrefrigerated conditions; and, in the case of the lid lining, the further property of defoliation. As a particular feature of the invention, the bottom and lid linings may be constituted of vinyl resin-based lacquers of specifically different compositions, wherein the lid lining lacquer incorporates as a resin system a mixture of vinyl and acrylic resins while the bottom lining lacquer has as a resin system a mixture of vinyl and low molecular weight epoxy resins together with a suitable cross-linking agent or other ingredient having a linking effect.

Typical resin blends which may be employed include vinyl copolymers with reactive hydroxyl or carboxyl groups and low molecular weight epoxy resins of the diepoxide type. Suitable cross-linking agents include butylated melamine or other substituted melamins or aliphatic pre-condensated isocyanates. The cross-linking reaction runs at an optimum at temperatures greater than 180° C with a surplus of vinyls and epoxies so that only traces of unreacted cross-linking agent remain in the coating; i.e. the cross-linking reaction stops at a point at which the coating retains sufficient thermoplasticity for heat sealing.

It is found that an aluminum foil package having such lacquer coatings can be heat-sealed and sterilized to provide a fully sealed, sterilized container which can nevertheless be opened by manually peeling off the lid, without tearing of the lid or separation of the lid foil and lining, because the lacquer seal defoliates evenly from the lid when the lid is thus peeled.

An additional advantage of the use of lacquers for the linings resides in the facility with which lining properties may be tailored to the specific requirements of a particular application by variations of composition, since the compositions of these lacquers (i.e. lacquers which are broadly suitable for the purposes of the present invention) are capable of substantial variation e.g. in relative proportions and/or selection of specific resins used.

Further features and advantages of the invention will be apparent from the detailed description hereinbelow set forth, together with the accompanying drawing.

BRIEF DESCRIPTION OF THE DRAWING

FIG. 1 is a perspective view of a foil container embodying the present invention in a particular form;

FIG. 2 is an enlarged fragmentary elevational sectional view of one side portion of the container, with the lid sealed to the bottom;

FIG. 3 is a view similar to FIG. 2 but showing the lid being peeled away; and FIG. 4 is an enlarged perspective view of a marginal portion of the lid undersurface after peeling, further illustrating the property of defoliation.

DETAILED DESCRIPTION

For purposes of specific example, the invention will be described as embodied in a container 10 (FIG. 1) having a bottom 11 and lid 12 both fabricated of aluminum. In the illustrated embodiment of the invention, the container 10 is generally rectangular in plan, with rounded corners. It will be understood that the rectangular container shape shown is merely exemplary and that the invention may be embodied in containers of circular or other configuration as well.

The bottom 10 is formed from light-gauge sheet, or from foil sheet of sufficiently heavy gauge to sustain its illustrated shape when filled with a food product or the like. A suitable range of gauges for the bottom, in this embodiment, is about 0.001 – 0.012 inch; conventionally, the term "foil" is used for sheet up to 0.008 inch in thickness. The bottom has a base 14 and side walls 15 integral therewith, cooperatively defining an upwardly open but otherwise fully liquid- and gas-tight receptacle. The upper edges of the side walls are bent outwardly to provide a continuous annular lip or rim 16 extending entirely around the circumference of the container with the outer margin of the lip shaped to form a bead 18.

The lid 12 is a single continuous sheet of aluminum foil, typically somewhat lighter in gauge (e.g. about 0.001 – 0.005 inch) than the foil of the bottom for desired flexibility and ease of peeling. As shown, the lid is generally rectangular in configuration with three rounded corners corresponding to three of the corners of the bottom, and is so dimensioned that the peripheral edge 20 of the lid uniformly overlies the lip 16 of the bottom (terminating just inwardly of the bead 18), thereby to provide full closure of the package. The fourth corner 22 of the lid is not rounded, but instead projects outwardly beyond the underlying rounded corner 23 of the lip, to constitute a free tab that can readily be grasped for manual peeling of the lid from the bottom.

As best seen in FIGS. 2 and 3, the inner surface of the bottom 10 is entirely covered with a first lining 24 of thermoplastic material, i.e. a layer or coating of the thermoplastic material which adheres fully and uniformly to the inner foil surface of the bottom. This coating extends over the entire upwardly facing surface of the lip 16. Similarly, the inner or downwardly facing surface of the lid 12 is entirely covered with a second lining 26 of thermoplastic material which completely coats and uniformly adheres to the lid foil surface and extends outwardly to the edges thereof, so that when the lid is placed on the bottom with its peripheral edge overlying the lip 16, the peripheral portion of the lid lining 26 is in facing contact with the portion of the bottom lining 24 that coats the lip. The linings 24 and 26 are bonded together to form a seal 28 extending entirely around the circumference of the package and holding the lid securely on the bottom, thus providing fully sealed enclosure of the package contents. Stated in general, the thermoplastic material or materials of the linings 24 and 26 are selected to be inert with respect to the contents of the package, so as not to be attacked e.g. by acids or salt in the contained food, and are selected to have a melting range above the temperature of sterilization (e.g. about 120° – 125° C) so that sterilization procedures will not disrupt the integrity of the linings and the seal they cooperatively provide.

In accordance with the present invention, and as a particular feature thereof, the thermoplastic material constituting the lid lining 26 (in addition to satisfying the foregoing general criteria) is a material that effectively and reliably adheres to the aluminum foil surface of the lid and to the first lining material at temperatures ranging upwardly through sterilization temperatures of e.g. about 120° C, and which forms with the first lining material a sterilizable seal that provides a shelf-stable package and parts by defoliation from the lid when the lid is peeled manually from the bottom.

More particularly, the package of the invention advantageously has lid and bottom linings characterized by such bonding and strength properties that peeling of the lid selectively strips the material of seal 28 (including the lid lining portion previously incorporated in the seal by bonding) from the metal surface of the lid, leaving the seal material fully adherent to the bottom rim 16, and also leaving the remainder of the lid lining 26 fully adherent to the lid. This selective defoliation of the seal 28 (or more precisely the seal-forming portion of lid lining 26) exposes bare metal of the lid as indicated at 30 in FIGS. 3 and 4, but this is of no consequence; since the metal of the bottom rim remains fully covered with lining material, there is no unsightly marring or disfigurement of the rim as would occur if lining material were stripped therefrom.

As best shown in FIG. 4, when the lid is peeled, that portion of the lid lining which is united with the bottom lining (i.e. to form the seal 28 along the rim) parts from the remainder of the lid lining quite smoothly and uniformly along the lateral margin or margins of the seal. Consequently, the rim 16 of the opened container is essentially completely free of loose scraps or tatters of lid lining material which again would detract from the desired appearance of the rim. In other words, essentially only that portion of the lid lining which is bonded to the bottom lining at the rim is stripped from the lid.

This property of selective defoliation of the seal 28 from the lid may be explained as follows: the strength of the bond between the bottom lining 24 and the rim metal, and also the strength of the seal 28 formed by bonding linings 24 and 26, are both greater than the strength of the bond between the lid lining 26 and the lid metal, but the latter bonding strength exceeds the tearing strength of the lid lining material per se. Thus, when the lid is peeled, the lid lining material which is bonded to bottom lining material at seal 28 pulls away from the lid metal but also separates cleanly from the adjacent lid lining material along the margins of the seal.

In fabricating a container of the type shown, the linings are first applied to sheet or foil for the bottom and lid. The bottom 11 may then be formed as by deep-drawing. The food to be packaged is placed in the bottom, and covered over by the coated foil stock for the lid; thereafter any food which may be interposed between the rim 16 and the lid material is expelled by application of high pressure at the rim, and the package is heat-sealed to bond the linings 24 and 26 together entirely around the rim (thereby forming the seal 28) under appropriate conditions of elevated temperature and pressure, and the lid is cut or trimmed to size. The sealed package may be sterilized, e.g. by heating to a temperature in the range of about 120° – 125° C; after sterilization, the seal 28 maintains the sterility of the contents providing a shelf-stable package for room temperature storage.

As embodied in a package of the type described, the present invention resides in the use of certain lacquer compositions (hereinafter set forth) to provide the linings for the bottom and the lid. The lacquer for the bottom lining may incorporate, as a resin system, a mixture of vinyl and epoxy resins with a cross-linking agent, while the lid lining lacquer may have a vinyl-acrylic resin system. The vinyl resins employed for both may include vinyl copolymers with reactive hydroxyl and carboxyl groups, the relative proportions of such groups in the lid lining and bottom lining being specifically different from each other.

Thus, the bottom lining may be constituted of a lacquer which incorporates a two-component (vinyl and epoxy) resin system and a cross-linking agent in a solvent, characterized by a controllable cross-linking reaction and the properties of being sufficiently thermoplastic for heat-sealing, , providing a heat seal (i.e. between the lid and bottom) that maintains a peel strength of at least about 800 – 1000 gr. when subjected to sterilization at temperatures of about 120° – 125° C, and being inert with respect to the food contents of the package, i.e. being resistant to attack by food acids and salt (this being also a requirement for the lid lining). In this lacquer, the relative proportions are such that a surplus of the resins (in relation to the cross-linking agent) is initially present, i.e. so that only trace amounts of unreacted cross-linking agent remain in the coating and the cross-linking reaction stops while the coating remains sufficiently thermoplastic to be heat-sealable. The cross-linking reaction runs at an optimum at temperatures above 180° C. Suitable vinyl resins include vinyl copolymers with reactive hydroxyl or carboxyl groups. Suitable epoxy resins include low-molecular-weight epoxy resins of the diepoxide type, i.e. having a molecular weight between about 300 and about 900, with two epoxy groups per mole. Suitable cross-linking agents include butylated melamine or other substituted melamins or aliphatic pre-condensated isocyanates.

The lid lining may have a resin system which is a mixture of vinyl and acrylic resins, again in a suitable solvent system. For the lid lining as for the bottom lining, suitable vinyl resins include vinyl copolymers with reactive hydroxyl or carboxyl groups. However, it is preferred that the vinyl resin used for the bottom lining have a relatively higher carboxyl content and that the vinyl resin used for the lid lining have a relatively higher hydroxyl content, exemplary ratios of relative proportions (carboxyl : hydroxyl) being about 3:2 for the bottom lining resin and about 2:3 for the lid lining resin. In this connection, it may be explained that hydroxyl groups are better for cross-linking while carboxyl groups are better for adhesion.

Exemplary ranges of proportions for bottom and lid lining lacquer compositions in accordance with the invention are as follows:

| | Bottom | Lid |
|---|---|---|
| vinyl resins | 12 - 15 parts[1] | 5 - 7 parts[2] |
| epoxy resins | 3.5 - 4 parts | — 0 — |
| acrylic resins | — 0 — | 17 - 19 parts |
| cross-linking agent | 2 - 2.5 parts | — 0 — |
| solvent blend | balance to 100% | balance to 100% |

[1]Mixture of vinyl copolymers, respectively containing free carboxyl and free hydroxyl groups, in a ratio of about 3:2

[2]Mixture of vinyl copolymers, respectively containing free carboxyl and free hydroxyl groups, in a ratio of about 2:3.

[1] Mixture of vinyl copolymers, respectively containing free carboxyl and free hydroxyl groups, in a ratio of about 3:2

[2] Mixture of vinyl copolymers, respectively containing free carboxyl and free hydroxyl groups, in a ratio of about 2:3.

A presently preferred lacquer composition in accordance with the invention, for use to provide the bottom lining 24, consists essentially of about 45% polyvinyl terpolymer, about 30% polyvinyl chloride-acetate, about 15% precondensed isocyanate, and about 10% epoxies, all percentages herein being expressed by weight. The polyvinyl terpolymer contains 1% free carboxyl groups and polyvinyl chloride-acetate contains free hydroxyl groups. The above-mentioned blend of resins is dissolved in about three times its weight of solvents, utilizing a solvent mixture of 75% methylethylketone, 15% toluene, and 10% ethylacetate. One example of a suitable epoxy resin for the foregoing composition is the resin commercially available from Union Carbide Corporation under the trade name "Bakelite" designated "ERL-2774." This is a monomeric, low-molecular weight, diepoxide epoxy resin possessing a high proportion of reactive epoxy groups. Another example is the resin commercially available from Shell Corporation under the trade name "EPIKOTE 828," which has an average molecular weight of 380, and (like ERL-2774) two epoxy groups per mol, with an epoxy assay of 180–190 g/g mole. The epoxy assay of ERL-2774 is 180–195 g/g mole.

Other examples of such sterilizable cross-linked lacquers may contain, e.g., butylated melamine and cymel resins instead of pre-condensed isocyanates. Such blends also may contain paratoluene-sulfuric acid as a catalyst. If an opaque white coating is desired, titanium dioxide may be incorporated in the mixture; in such case the cross-linking agent may be omitted from the bottom lining lacquer, since the titanium dioxide provides sufficient effective cross-linking although it does not disappear, as does a cross-linking agent. Other pigments may be incorporated in the lacquers to provide opaque linings of other colors, e.g. yellow organic pigment for a yellow lining, or carbon black for a grey lining.

In preparing an aluminum foil package in accordance with the invention, the appropriate surfaces of the sheets for the bottom and the lid are coated with lacquer compositions as described above, and the coatings are cured at about 180°–195° C to effectuate cross-linking and to provide the thermoplastic linings 24 and 26. It will be understood that since a surplus of the resins (in relation to cross-linking agent) is initially present in the bottom lining lacquer composition, only traces of unreacted cross-linking agent are present in the cured bottom lining (i.e. when such agent is used therein), and the lining is sufficiently thermoplastic to be heat-sealable. The thus-formed linings adhere effectively and reliably to the foil surfaces at temperatures up to and including sterilization temperatures of about 120°–121° C (or somewhat higher, e.g. up to about 125° C), and provide a fully reliable seal that nevertheless defoliates readily and evenly from the lid upon pulling of the tab 22 (i.e. in a direction transverse to the lid major surfaces) so that the lid can be peeled from the bottom to open the package.

In performance of curing as described above, the lid is cured at a lower temperature, and has a lower bond strength than the bottom lining, as well as having a different composition. Reasons for these differences include the fact that the lid sheet is not subject to deep drawing and is manufactured at higher speeds, so that it is feasible to use a relatively less costly material for the lid lining; also, the lower bond strength of the lid lining provides the desired defoliation upon peeling the lid from the bottom, i.e. with separation of the seal-forming portion of the lid lining from the lid metal accompanied by tearing of this portion from the remainder of the lid lining, and maintained adherence of the bottom lining to the rim 16.

A further lacquer system, suitable for providing the lid lining 26 when the bottom lining 24 is constituted of polypropylene, is based on low molecular weight polypropylene resins, for example resin 4257 manufactured by Swale Chemicals Ltd. or resin Adcote 491-75A manufactured by Morton Chemical Comp. This system also provides a sealable and sterilizable package having a peelable lid.

It is to be understood that the invention is not limited to the features and embodiments hereinabove specifically set forth but may be carried out in other ways without departure from its spirit.

I claim:

1. A sterilizable, shelf-stable, easily openable package comprising:

a. a light-gauge sheet metal bottom having an inner surface defining a receptacle for material to be packed and a continuous peripheral rim;

b. a first lining of thermoplastic material extending over, and adhering to, the entire inner surface of said bottom including said rim;

c. a light-gauge sheet metal lid extending over said bottom and having a peripheral edge portion continuously overlying said rim;

d. a second lining of thermoplastic material extending over, and adhering to, the entire surface of said lid facing said bottom, including the peripheral edge portion thereof, e. said second lining adjacent said peripheral edge portion being in continuous contact with, and sealed to, the portion of said first lining at said rim, around the entire periphery of the package;

f. each of said linings consisting essentially of the cured product of a vinyl resin based lacquer composition which is resistant to attack by food acids and salt and has a melting range above about 125° C and which forms with the other lining a seal that parts by defoliation from the lid when the lid is peeled manually from the bottom, g. said linings being respectively constituted of different compositions having respectively different bond strengths such that the second lining peels more readily from the lid than the first lining peels from the bottom.

2. A package comprising:

a. a light-gauge sheet metal bottom having an inner surface defining a receptacle for material to be packed and a continuous peripheral rim;

b. a first lining extending over and adhering to the entire inner surface of said package, said first lining consisting essentially of the cured product of a first lacquer composition comprising a mixture of vinyl and epoxy resins and a linking compound in a solvent;

c. a light-gauge sheet metal lid extending over said bottom and having a peripheral edge portion continuously overlying said rim; and d. a second lining of thermoplastic material extending over, and adhering to, the entire surface of said lid facing said bottom, including the peripheral edge portion thereof, said second lining consisting essentially of the cured product of a second lacquer composition comprising a mixture of vinyl and acrylic resins in a solvent;

e. said second lining adjacent said peripheral edge portion being in continuous contact with, and sealed to, the portion of said first lining at said rim, around the entire periphery of the package.

3. A package as defined in claim 2, wherein said epoxy resin comprises a diepoxide having a molecular weight between about 300 and about 900, and wherein said vinyl resins of said first and second linings each comprise a mixture of vinyl copolymers containing free hydroxyl and carboxyl groups.

4. A package as defined in claim 3, wherein said linking compound is a cross-linking agent and said first lacquer composition contains a surplus of resins in relation to the amount of cross-linking agent present.

5. A package as defined in claim 4, wherein said first lacquer composition comprises about 12 to about 15 parts vinyl resins, about 3.5 to about 4 parts epoxy resin, about 2 to about 2.5 parts cross-linking agent, balance solvent; and wherein said second lacquer composition comprises about 5 to about 7 parts vinyl resins, about 17 to about 19 parts acrylic resin, balance solvent.

6. A package as defined in claim 5, wherein the mixture of vinyl copolymers of said first lacquer composition contains free carboxyl and hydroxyl groups in a ratio of about 3 to 2, and the mixture of vinyl copolymers of said second lacquer composition contains free carboxyl and hydroxyl groups in a ratio of about 2 to 3.

7. A package as defined in claim 6, wherein said cross-linking agent is selected from the class consisting of substituted melamins and aliphatic pre-condensated isocyanates.

8. A package as defined in claim 7, wherein said cross-linking agent is pre-condensed isocyanate.

9. A package as defined in claim 7, wherein said cross-linking agent is butylated melamine.

10. A package as defined in claim 7, wherein said vinyl copolymers are polyvinyl terpolymer and polyvinyl chloride-acetate.

11. A package as defined in claim 10, wherein said mixture, exclusive of solvent, consists essentially of about 45 percent by weight polyvinyl terpolymer, about 30 percent by weight polyvinyl chloride-acetate, about 15 percent by weight pre-condensed isocyanate, and about 10 percent by weight of said epoxy resin.

12. A package as defined in claim 3, wherein said linking compound is titanium dioxide.

13. A package as defined in claim 3, further including a pigment in each of said lacquer compositions.

14. A package as defined in claim 3, wherein the ratio of free carboxyl groups to free hydroxyl groups in the mixture of vinyl copolymers in said first lacquer composition is greater than that in said second lacquer composition.

15. A package as defined in claim 2, wherein said metal is aluminum.

16. A package as defined in claim 15, wherein said light-gauge sheet is foil.

17. A sterilizable, easily openable package comprising:

a. a light-gauge sheet metal bottom having an inner surface defining a receptacle for material to be packed and a continuous peripheral rim;

b. a first lining of thermoplastic material extending over, and adhering to, the entire inner surface of said bottom including said rim;

c. a light-gauge sheet metal lid extending over said bottom and having a peripheral edge portion continuously overlying said rim;

d. a second lining of thermoplastic material extending over, and adhering to, the entire surface of said lid facing said bottom, including the peripheral edge portion thereof, e. said second lining at said peripheral edge portion being in continuous contact with, and sealed to, the portion of said first lining at said rim, around the entire periphery of the package;

f. said first lining being a lining of polypropylene; and g. said second lining consisting essentially of the cured product of a lacquer composition comprising low molecular weight polypropylene resin.

* * * * *